US005938431A

United States Patent [19]

Thevenet et al.

[11] Patent Number: 5,938,431

[45] Date of Patent: Aug. 17, 1999

[54] DEVICE FOR ENSURING THE REPLACEMENT OF A STRIP SUPPORT ROLL IN HEAT TREATMENT FURNACE

[75] Inventors: Pascal Francis Thevenet, Les Lilas; Guy Mace, Evry, both of France

[73] Assignee: Stein Heurtey, Ris-Orangis, France

[21] Appl. No.: 09/030,960

[22] Filed: Feb. 26, 1998

[30] Foreign Application Priority Data

Feb. 27, 1997 [FR] France ..... 97 02365

[51] Int. Cl.[6] ..... F27D 23/00

[52] U.S. Cl. ..... 432/76; 432/77; 432/59; 432/246

[58] Field of Search ..... 432/3, 8, 59, 236, 432/246; 34/216, 217; 414/159, 196; 198/782

[56] References Cited

U.S. PATENT DOCUMENTS 4,049,372 9/1977 Bloom .

FOREIGN PATENT DOCUMENTS 0 101 931 3/1984 European Pat. Off. .
2540138 8/1984 France .
30 04 805 10/1981 Germany .
37 35 542 5/1989 Germany .

*Primary Examiner*—Teresa Walberg
*Assistant Examiner*—Jiping Lu
*Attorney, Agent, or Firm*—Pollock, Vande Sande & Amernick

[57] ABSTRACT

This device comprises: two pairs of lateral flanges rotatably mounted respectively on a shaft pivoting in the frame of the furnace, each pair of flanges receiving a strip support roll by the agency of removable fastening means; means for driving said pairs of lateral flanges, ensuring that their angular displacement is synchronized during the interchange operations; central buffer provided with raising means, which is designed to shut off the orifice provided in the hearth of the furnace, for carrying out the operations of discharging a roll outwards from the furnace containment at the end of an interchange operation; two raisable buffers, one for each support roll, which may be displaced in a vertical translational movement in order respectively:

to ensure the sealing of the orifice provided in the hearth of the furnace during the roll interchange phase;

to ensure that the rolls are supported when the roll bearings are demounted in order to remove the inoperative roll from the corresponding flanges, and to carry out the lowering of the inoperative roll in order to release it from its flanges;

two carriages which are movable transversely relative to the axis of the furnace and on which are respectively mounted the said raisable buffers and their raising system, the said carriages being displaced along running tracks, and a drive assembly for each support roll so as to obtain a rotation of each roll in synchronism with the speed of travel of the strip.

10 Claims, 3 Drawing Sheets

DEVICE FOR ENSURING THE REPLACEMENT OF A STRIP SUPPORT ROLL IN HEAT TREATMENT FURNACE

BACKGROUND OF THE INVENTION

The present invention relates to a device designed to ensure the replacement of a support roll for a strip, in particular a steel strip, travelling continuously through a heat treatment furnace, without interrupting this treatment, that is to say the displacement of the strip in the furnace.

BRIEF SUMMARY OF THE INVENTION

FR-A-2,540,138 discloses a device making it possible to carry out the replacement of a strip support roll by another roll in a heat treatment furnace. According to this prior device, the two interchangeable rolls are placed, in diametrically opposed positions, on the periphery of a cylinder mounted on a supporting structure, the rotation of this cylinder about its axis making it possible to substitute one roll for another. The disadvantage of this prior solution is that, on the one hand, when the roll is being changed, the supporting cylinder, on which the strip being displaced then comes to bear, can be difficult to drive at the same rotational speed as that of the said strip, the latter being liable to be damaged thereby, and that, on the other hand, cooling means have to be provided not only on the two interchangeable rolls, but also on their supporting cylinder, since the latter comes into contact with the strip being displaced, during roll-changing operations, and that, if such cooling is absent, the properties of the treated strip could be impaired. The result of these disadvantages is that this solution according to the prior art is unreliable, complex and therefore costly to manufacture and maintain.

The present invention therefore proposes to provide another solution to the problem which involves, in a furnace for the heat treatment of strips being continuously displaced, replacing a support roll by a new roll, without interrupting the displacement of the strip, this new solution being free of the disadvantages of the device according to the prior art mentioned above.

The subject of this invention is, therefore, a device intended for ensuring the replacement of a support roll for a strip, in particular a steel strip, travelling continuously through a heat treatment furnace, without interrupting the treatment process, by interchange with a second identical roll arranged in a stand-by position, the said strip always being supported by at least one of the said rolls during the interchange operations, this device being characterized in that it comprises:

- two pairs of lateral flanges rotatably mounted respectively on a shaft pivoting in the frame of the furnace, each pair of flanges receiving a strip support roll by the agency of removable fastening means;
- means for driving the said pairs of lateral flanges, ensuring that their angular displacement is synchronized during the interchange operations;
- a central buffer provided with raising means, which is designed to shut off the orifice provided in the hearth of the furnace, for the purpose of carrying out the operations of discharging a roll outwards from the furnace containment at the end of an interchange operation;
- two raisable buffers, one for each support roll, which are capable of being displaced, for example by means of a jack system, in a vertical translational movement in order respectively:

- to ensure the sealing of the orifice provided in the hearth of the furnace during the roll interchange phase;
  - to ensure that the rolls are supported when the of the roll bearings are demounted in order to remove the inoperative roll from the corresponding flanges, and
  - to carry out the lowering of the inoperative roll in order to release it from its flanges; two carriages which are movable transversely relative to the axis of the furnace and on which are respectively mounted the said raisable buffers and their raising system, the said carriages being displaced along running tracks, so as to ensure the displacement of the inoperative roll in order to discharge it from the furnace and install a new roll, and
- a drive assembly for each of the support rolls, so as to carry out a rotation of each roll in synchronism with the speed of travel of the strip.

According to one characteristic of the present invention, each of the said support rolls is provided with cooling means, these means being capable of being designed so as to ensure, furthermore, a rapid cooling of the said rolls in the low position, when they are being discharged after the interchange operations.

According to another characteristic of the present invention, each support roll is mounted on its flanges by means of a radial long hole or slot provided on each of the said flanges, for the purpose of receiving the corresponding roll support bearing, and the means ensuring that each support roll is fastened removably to its flanges are produced in the form of counterplates, on which the said bearings are respectively mounted, these counterplates being, for example, screwed or bolted to the said flanges.

According to another characteristic of the invention, the shaft, on which each of the said flanges pivots, is water-cooled. In order to avoid the need for means for cooling by water circulation, the shaft may be protected by a lining made of a refractory material and which may be produced, for example, in the form of an assembly of compressed ceramic fibers.

According to the present invention, the said central buffer may be produced in two parts, each provided with displacement means, making it possible to ensure that they are raised separately from one another.

Other characteristics and advantages of the present invention will emerge from the description given below with reference to the accompanying drawings which illustrate an exemplary embodiment of it which has no limiting character.

DETAILED DESCRIPTION

As indicated in the introduction to this description, the device of the present invention is designed to ensure permanently the property of guiding the strip through the furnace, without impairing this guidance or the quality of the product during the operation of interchanging the strip support roll. For this purpose, a roll must be capable of being replaced, without stopping the travel of the strip, by being interchanged with a second identical roll arranged in a stand-by position, the strip always being supported by at least one roll during the operations of interchanging and demounting the roll to be put out of operation, the operative support roll always being driven in rotation synchronously with the speed of travel of the strip.

Figure 1:
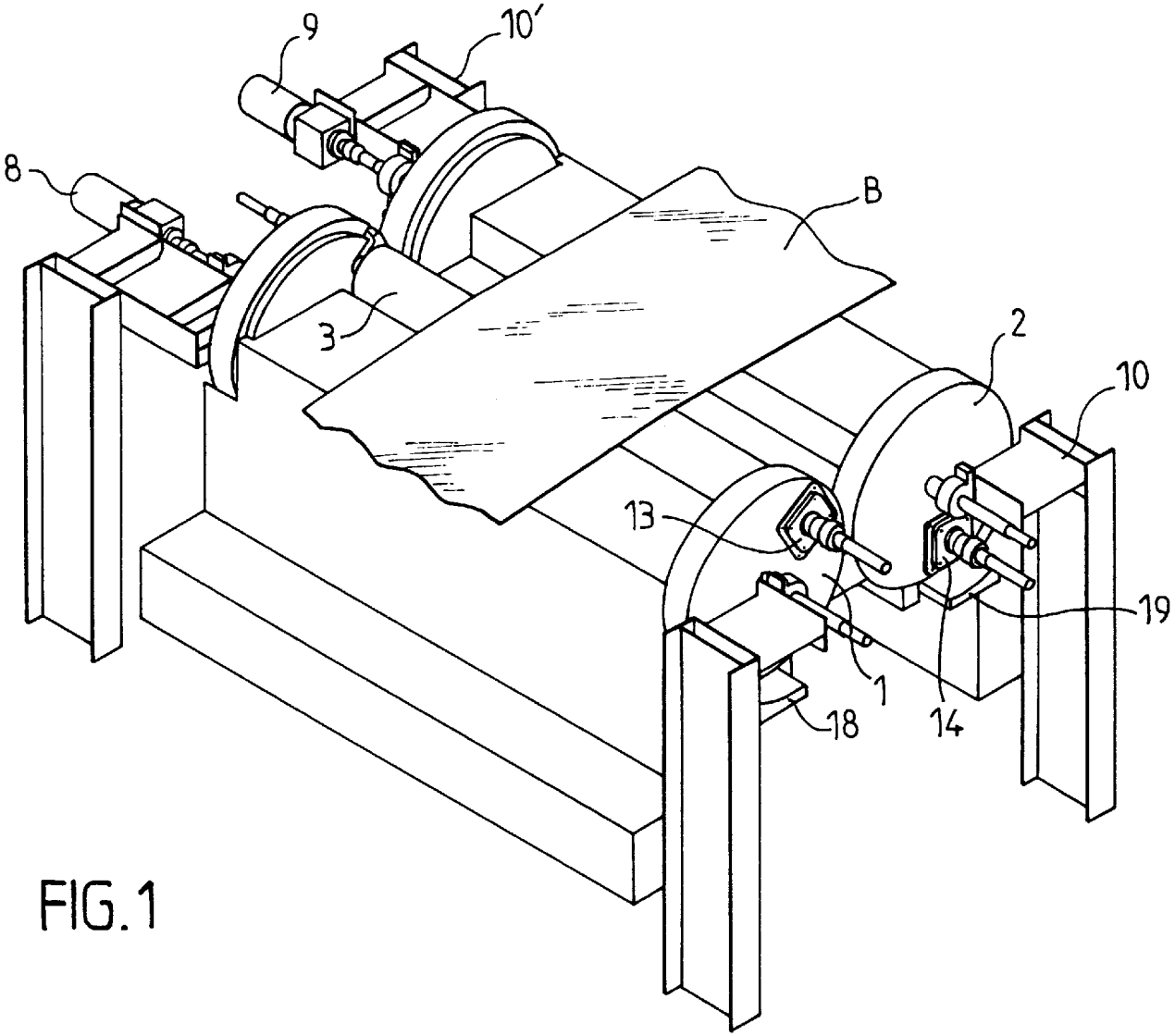
FIG. 1 is a diagrammatic view showing the device according to the present invention in perspective.

For this purpose, the device which is the subject of the invention comprises two lateral flanges 1 and 2 designed to receive respectively the bearings of the support rolls 3 and 4. The flanges 1 and 2 are mounted respectively on a central shaft 5 and 6 which, if appropriate, is cooled by the circulation of water. The shafts, such as S and 6, may be protected, for example, by a lining made of a refractory material, making it possible to avoid the presence of water-cooling means. This protection of the shafts 5, 6 may be carried out by means of an assembly 7 of compressed ceramic fibers. The shafts 5 and 6 of the lateral flanges 1 and 2 are driven in rotation respectively by means of a motor unit 8, 9, the drive being carried out so as to ensure that the angular displacements of the lateral flanges 1, 2 are synchronized, in order to ensure the position of the support roll (for example, the roll 3 in FIG. 1) in the working position.

The respective bearings of the shafts 5 and 6 of the lateral flanges 1 and 2 are mounted on the frame of the furnace, on elements of the latter, such as 10 and 10', on either side of the furnace.

The strip support rolls 3 and 4 are mounted removably on the corresponding lateral flanges 1 and 2 respectively. For this purpose, these flanges comprise a radial slot or long hole, such as 11, 12 (FIG. 2), intended for receiving respectively a bearing of a support roll. Each bearing of support rolls 3 and 4 is fastened to a counterplate, such as 13, 14, with the aid of suitable fastening means, for example by screwing or bolting, in order to make it possible to demount these bearings easily and quickly. Each support roll 3 or 4 is driven in rotation by means of a drive assembly, such as 15, and of a double cardan transmission system, as may be seen clearly in FIG. 3, the rotation of each roll being synchronized with the speed of travel of the strip B.

Each of the said support rolls 3 and 4 is provided with cooling means, these means being capable of being designed or produced so as to ensure, furthermore, a rapid cooling of the said rolls, when these are brought into the low position, as will be described below, when they are being discharged after the interchange operations.

The device comprises, furthermore, a raisable central buffer 16 making it possible to shut off the low orifice provided in the hearth of the furnace, in order to ensure that a support roll, such as 3 or 4, is discharged outwards from the furnace containment at the end of an interchange operation, as will be described below. In the exemplary embodiment illustrated in FIG. 2, the central buffer 16 may be displaced in a vertical translational movement by means of a double-jack system designated as a whole by the reference 17.

Moreover, the invention provides a respective raisable buffer 18 and 19 under each lateral flange 1 and 2. The functions of each of the said raisable buffers are as follows:

- to ensure the sealing of the orifice provided in the hearth of the furnace during support-roll interchange operations;
- to support a new roll to be positioned on its lateral flanges, during a roll replacement, or to support a worn roll, in order to make it possible to demount it from its bearings before it is discharged after an interchange operation, and
- to ensure the lowering of the worn roll in order to release it from its supporting flanges or to ensure the raising of a new roll in order to engage its bearings on the long holes or slots provided to this effect on its support flanges.

For this purpose, each raisable buffer, such as 18 and 19, is provided with a system of jacks 20, 20' mounted respectively on a carriage 21, 22 which is displaced along a running track 23, 24 respectively.

Figure 2:
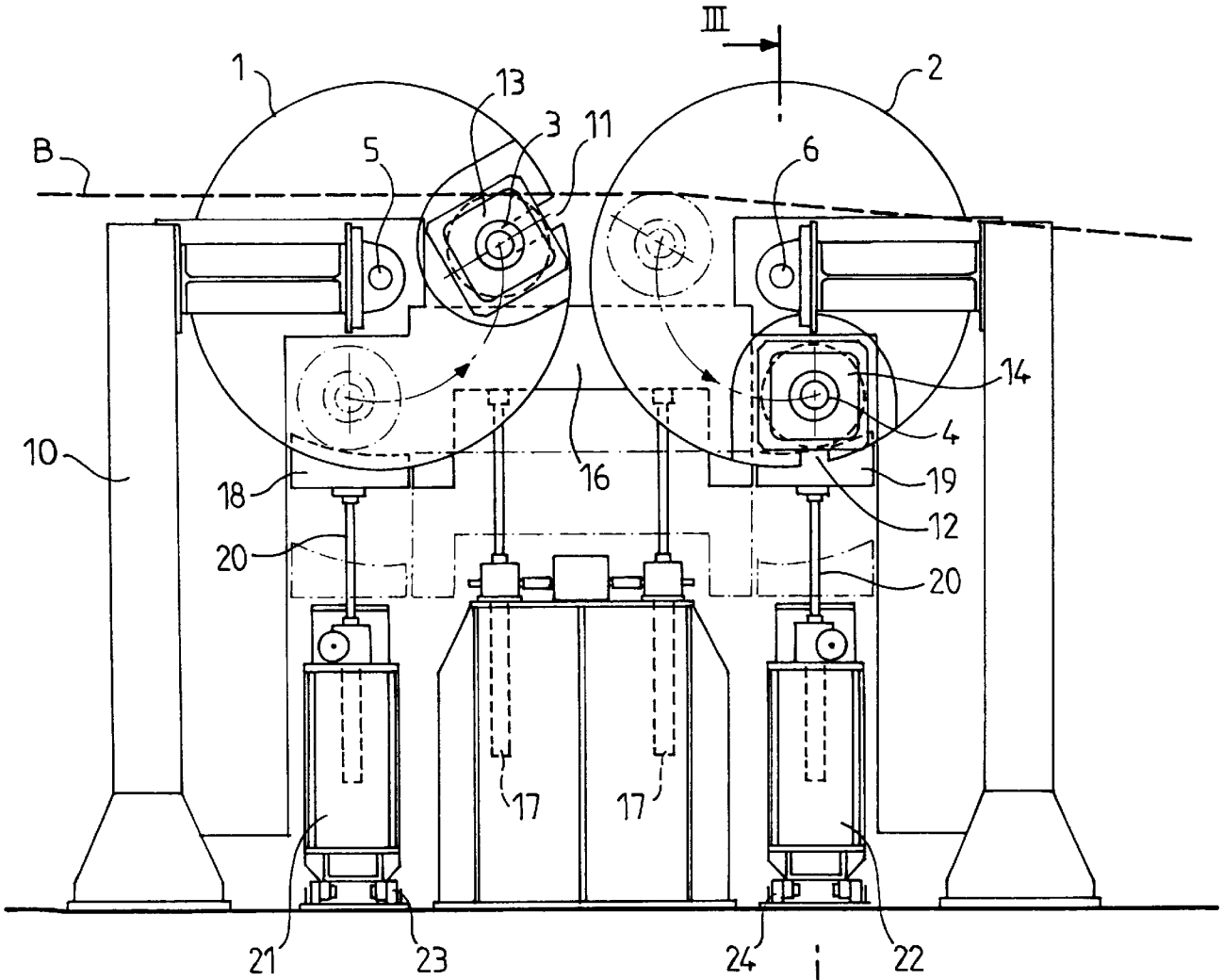
FIG. 2 is a front elevation view of the device according to the invention.
Figure 3:
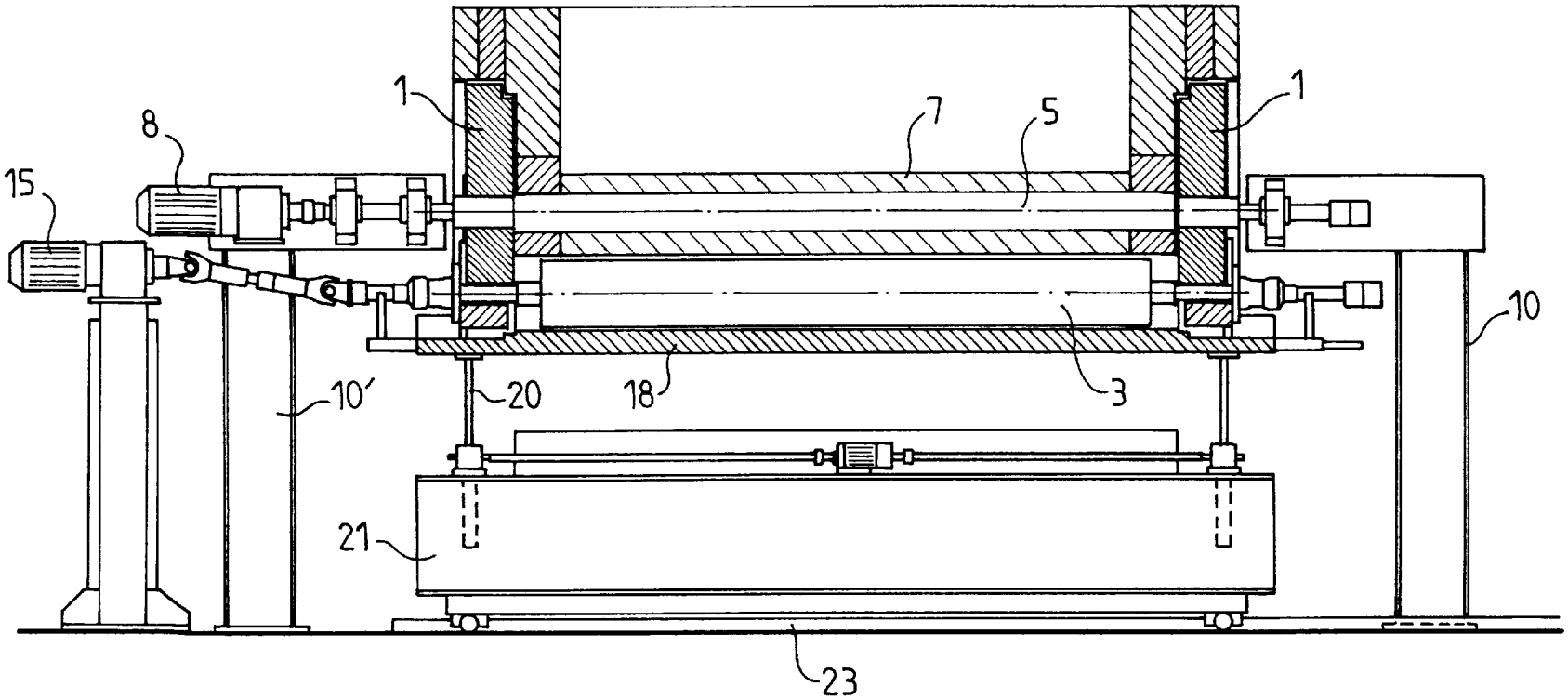
FIG. 3 is a sectional view according to III—III of FIG. 2.

The device according to the invention functions as follows:

Referring to FIG. 2, it can be seen that the operative strip support roll is the roll 3 supported by the pair of lateral flanges 1. The roll 4 supported by the lateral flanges 2 is in the stand-by position.

When the roll 3 is worn, it is expedient to interchange it with the new roll 4 in the stand-by position. The first phase of this interchange operation involves displacing the central buffer 16 downwards, in order to make it possible to rotate the lateral flanges 1 and 2. This displacement takes place by means of jack systems 17, and FIG. 2 illustrates by dot-and-dash lines the position of the central buffer 16 at the end of this first phase. The control units 8 and 9 for driving the lateral flanges 1 and 2 in synchronized rotation are then activated so as to bring the roll 4 into contact with the strip, this roll being driven in rotation synchronized with the speed of travel of the strip B. The worn roll 3 is subsequently displaced as a result of the rotation of its supporting flanges 1, so as to move it away from the strip. It will be noted that, during this support-roll interchange phase, the synchronization of the angular displacements of the lateral flanges 1, 2 supporting the rolls 3 and 4 has been ensured in order to ensure the position of a support roll 3 and 4 successively in the working position.

It is now appropriate to carry out the extraction of the worn roll 3 and its replacement by a new roll.

The jack system 17 ensures that the central buffer 16 is raised, in order to shut off the low Orifice provided in the hearth of the furnace (the position illustrated by unbroken lines in FIG. 2) and to ensure the sealing of the furnace.

The worn roll 3 which is to be discharged then rests on its raisable buffer 18 in the high position, this raisable buffer ensuring, furthermore, the sealing of the orifice of the hearth of the furnace during this phase of discharging the roll 3. The demounting of the bearings of the roll 3 is then carried out, and then the latter is released from the slots 11 provided in its supporting flanges 1. The jack system 20 is subsequently actuated, so as to ensure the lowering of the roll 3 supported by the buffer 18, thereby releasing this roll from its flanges 1. The worn roll is subsequently discharged outwards by means of the carriage 21 and removed, for example, by means of a travelling crane.

It is subsequently appropriate to install a new roll on the buffer 18 which has been freed of the worn roll 3.

The new roll is therefore positioned on the buffer 18, and the carriage 21 is displaced along its running track 23, so as to bring the roll supported by the buffer 18 below the position of the flanges 1 intended for supporting it. The jack system 20 is then actuated in order to raise the buffer 20, so as to bring the bearings of the new roll into engagement in the radial slots or long holes 11 provided in the flanges 1.

The counterplates, such as 13, which ensure that the bearings of the new roll are held on the flanges 1, are subsequently fastened. This new roll is ready to be put into operation when it has to be interchanged with the currently operative roll 4. FIG. 2 illustrates by broken lines the rotational movements of the flanges 1 and 2 which are generated during this interchange operation, at the end of which the new roll positioned on the flanges 1 is put into operation and the roll 4, which is then the worn roll, is subsequently discharged, as described above.

The reading of the foregoing description reveals clearly the advantages afforded by the device which is the subject of the invention, in particular that whereby the quality of guidance of the strip through the furnace is ensured permanently, this strip always being supported by a roll, the rotation of which is always synchronized with its speed of travel. Moreover, the roll interchange operations take place in a simple way, without impairing the sealing of the furnace, by virtue of the means provided by the invention (buffers 18 and 19 and central is buffer 16), for maintaining this sealing.

It goes without saying that the present invention is not limited to the exemplary embodiments described and/or illustrated, but that it embraces all its variants which come within the scope of the accompanying claims. Thus, the central buffer 16 may be produced in two independent parts, separately movable, for example by means of separate jacks.

We claim:

1. Device for ensuring the replacement of a support roll for a strip, travelling continuously through a heat treatment furnace, without interrupting the treatment process, by interchange with a second identical roll arranged in a standby position, said strip always being supported by at least one of said rolls during interchange operations, this device comprising:

two pairs of lateral flanges rotatably mounted respectively on a shaft pivoting in a frame of the furnace, each pair of flanges receiving a strip support roll by removable fastening means;

means for driving said pairs of lateral flanges, ensuring that their angular displacement is synchronized during the interchange operations;

central buffer provided with raising means, which is designed to shut off an orifice provided in the hearth of the furnace, for the purposes of carrying out the operations of discharging a roll outwards at the end of the interchange operation;

two raisable buffers, one for each support roll, which are capable of being displaced in a vertical translational movement in order respectively:

to ensure the sealing of the orifice provided in the hearth of the furnace during the roll interchange phase;

to ensure that the rolls are supported when roll bearings are demounted in order to remove an inoperative roll from the corresponding flanges, and to carry out lowering of the inoperative roll in order to release it from its flanges;

two carriages which are movable transversely relative to an axis of the furnace and on which are respectively mounted said raisable buffers and their raising system, said carriages being displaced along running tracks, so as to ensure the displacement of the inoperative roll in order to discharge it from the furnace and install a new roll, and a drive assembly for each support roll so as to obtain a rotation of each roll in synchronism with the speed of travel of the strip.

2. Device according to claim 1, wherein each of said support rolls is provided with cooling means.

3. Device according to claim 2, wherein said cooling means are designed so as to ensure a rapid cooling of the said rolls in the low position, when they are being discharged after the interchange operations.

4. Device according to claim 1, wherein each support roll is mounted on its flanges by means of a radial long hole or slot provided on each of said flanges, for the purpose of receiving the corresponding roll support bearing.

5. Device according to claim 1, wherein the means ensuring that each support roll is fastened removably to its flanges are produced in the form of counterplates, on which the bearings of the said rolls are respectively mounted, these counterplates being screwed to said flanges.

6. Device according to claim 1 wherein the shaft on which each of said flanges pivots respectively, is water-cooled.

7. Device according to claim 1 wherein the shaft on which each of said flanges pivots respectively, is protected by a lining made of a refractory material.

8. Device according to claim 7, wherein said lining is produced in the form of an assembly of compressed ceramic fibers.

9. Device according to claim 1, wherein the means ensuring the raising and lowering movements of the buffers on the one hand, and of the central buffer are produced in the form of jack systems.

10. Device according to claim 1, wherein said central buffer is produced in two parts, each provided with displacement means, making it possible to ensure that they are raised separately from one another during the roll interchange operations.

* * * * *